US010791611B2

(12) United States Patent
Emerson et al.

(10) Patent No.: US 10,791,611 B2
(45) Date of Patent: Sep. 29, 2020

(54) LIGHT EMITTING DIODE (LED) LAMP WITH WIRELESS CONTROLLER

(71) Applicant: J & J ELECTRONICS, LLC, Irvine, CA (US)

(72) Inventors: Jeffrey Daniel Emerson, Sugar Hill, GA (US); Samir Harshadrai Shah, Chino Hills, CA (US); Alan Van Diep, Foothill Ranch, CA (US)

(73) Assignee: J & J ELECTRONICS, LLC, Irvine, CA (US)

( * ) Notice: Subject to any disclaimer, the term of this patent is extended or adjusted under 35 U.S.C. 154(b) by 1 day.

(21) Appl. No.: 16/182,128

(22) Filed: Nov. 6, 2018

(65) Prior Publication Data

US 2019/0174612 A1 Jun. 6, 2019

Related U.S. Application Data

(60) Provisional application No. 62/582,032, filed on Nov. 6, 2017.

(51) Int. Cl.

| | |
|---|---|
| ***H05B 47/10*** | (2020.01) |
| ***F21V 23/00*** | (2015.01) |
| ***H05B 47/19*** | (2020.01) |
| ***F21K 9/238*** | (2016.01) |
| ***H05B 45/00*** | (2020.01) |
| ***H05B 45/10*** | (2020.01) |
| *F21Y 115/10* | (2016.01) |
| *H01Q 1/22* | (2006.01) |

(52) U.S. Cl.

CPC ..... *H05B 47/19* (2020.01); *F21K 9/238* (2016.08); *F21V 23/003* (2013.01); *H05B 45/00* (2020.01); *H05B 45/10* (2020.01); *F21Y 2115/10* (2016.08); *H01Q 1/22* (2013.01)

(58) Field of Classification Search

CPC ..... H05B 37/02; H05B 37/0227; H05B 37/0272; H05B 33/08; H05B 33/0815; H05B 33/0842; H05B 45/10; H05B 45/00; H05B 47/19; H01Q 1/22; F21K 9/238; F21V 23/003; F21Y 2115/10

See application file for complete search history.

(56) References Cited

U.S. PATENT DOCUMENTS

2014/0292194 A1* 10/2014 Sagal ..... F21K 9/23 315/34

2015/0338077 A1* 11/2015 Johnson ..... F21V 23/005 362/234

* cited by examiner

*Primary Examiner* — Jimmy T Vu

(74) *Attorney, Agent, or Firm* — Gardner Groff & Greenwald, PC

(57) ABSTRACT

An LED lamp is provided that is capable of being wirelessly and remotely controlled by an LED lighting control device. The LED lamp includes an antenna on the lens of the LED lamp and is embedded in a raised section of lens material. Locating the antenna in the raised section of lens material allows the LED lamp to be controlled by a stronger control signal from the LED lighting control device at greater distances (e.g., typically greater than ten feet) and does not detract from the aesthetic appeal of the LED lamp.

20 Claims, 13 Drawing Sheets

LIGHT EMITTING DIODE (LED) LAMP WITH WIRELESS CONTROLLER

CROSS-REFERENCE TO RELATED APPLICATION

This application claims the benefit of U.S. Provisional Patent Application Ser. No. 62/582,032 filed Nov. 6, 2017, the entirety of which is hereby incorporated herein by reference for all purposes.

TECHNICAL FIELD

The invention relates generally to the field of electronics, and more particularly, to a light emitting diode (LED) lamp that is controlled remotely.

BACKGROUND OF THE INVENTION

LEDs are solid-state lamps that use semiconductor material, instead of a filament or neon gas, to emit light. When compared to traditional incandescent light bulbs, LEDs offer a number of advantages. For example, because LEDs operate on low voltage and consume less power, they are less expensive to operate and generate significantly less heat than traditional light bulbs. Also, because LEDs are of solid-state design, they are structurally more durable and less likely to break than traditional bulbs. Another advantage of LEDs is their rather long service life. Some LED lamps can operate for up to 100,000 hours, compared to about 1,500 hours for a standard incandescent filament light bulb. Moreover, LEDs are environmentally friendly, contain no mercury and produce no electromagnetic emissions. Another advantage is that a single LED bulb can produce many different colors without the need for colored coatings or lenses.

In view of their numerous advantages, LEDs are being used in many applications where fluorescent or incandescent lighting was previously used. For example, LED lighting is frequently being used to replace older incandescent lighting in swimming pools, spas, water features (e.g., decorative water falls), along pathways or walkways, and the like. In some instances, the replacement LED lighting may include different colored LEDs or multicolor LEDs and a control device that is programmed to cause the LEDs to emit light in a number of different lighting schemes (e.g., light shows using different colors and/or patterns of emitted light). Such LED lighting control devices typically have a user interface, such as a dial or selector on the face of the control device, for example, to allow a user to select a desired lighting scheme from a variety of pre-programmed lighting schemes.

Some LED lamps are capable of being controlled remotely via a Bluetooth wireless connection. To control an LED lighting control device via a Bluetooth wireless connection, the LED lamp has a separate antenna in the form of a wire hanging outside the LED lamp or the fixture in which the LED lamp is installed. The wire hanging outside of the lamp or fixture is aesthetically unattractive and can be easily damaged by the environment or landscaping tools. The wire is necessary, however, because the Bluetooth wireless signal will not travel far inside of the housing of the LED lamp, which is typically made of metal.

A need exists for an LED lamp that is controllable via a Bluetooth wireless link, that has an antenna for improved range and that is aesthetically attractive.

SUMMARY OF THE INVENTION

In a first example form, the present invention relates to a light emitting diode (LED) lamp. In the example form, the LED lamp includes a lamp housing including a body portion and a lens. At least one LED emitter is secured within the lamp housing and electrical circuitry is also secured within or to the lamp housing and is electrically coupled to the at least one LED emitter. An antenna is electrically coupled to the electrical circuitry. Advantageously, at least a portion of the antenna is positioned adjacent the lens.

Optionally, at least a portion of the antenna can be embedded in the lens itself. Also optionally, the lens can include a rib or raised portion that extends at least partly across the lens and wherein at least a portion of the antenna is embedded in the rib or raised portion. In one optional form, the rib substantially bisects the lens and the antenna traverses most of the lens.

Preferably, the housing includes a body portion and the lens and the body portion are separate elements and the lens is attached to the body portion with a fastener-free snap-fit.

Preferably, the electrical circuitry includes a Bluetooth transmitter. Also, preferably the antenna is a Bluetooth antenna.

In another example form, the present invention relates to a light emitting diode (LED) lamp including a housing having a lens and an LED disposed inside of the housing. An electrical circuitry is electrically coupled to the LED and an antenna is electrically coupled to the electrical circuitry. Preferably, at least a portion of the antenna is embedded in the lens.

Preferably, the housing includes a body portion and the lens and the body portion are separate elements and the lens is attached to the body portion with a fastener-free snap-fit.

Optionally, at least a portion of the antenna is embedded in a raised portion of the lens.

In another example form, the present invention relates to an LED lighting system having a plurality of LED lamps and a wireless controller. The LED lamps include a housing having a lens, an LED emitter, electrical circuitry, and an antenna coupled to the circuitry and positioned adjacent the lens. The wireless controller includes a controller housing, controller circuitry including a Bluetooth wireless transmitter, and a user interface. The controller circuitry is operative for sending Bluetooth signals from the wireless controller to the antennas in the LED lamps to effect remote, wireless control of the LED lamps from the wireless controller.

Optionally, at least a portion of the antenna can be embedded in the lens itself. Also optionally, the lens can include a rib or raised portion that extends at least partly across the lens and wherein at least a portion of the antenna is embedded in the rib or raised portion. In one optional form, the rib substantially bisects the lens and the antenna traverses most of the lens. Preferably, the antenna is a Bluetooth antenna.

WRITTEN DESCRIPTION

Figure 1A:
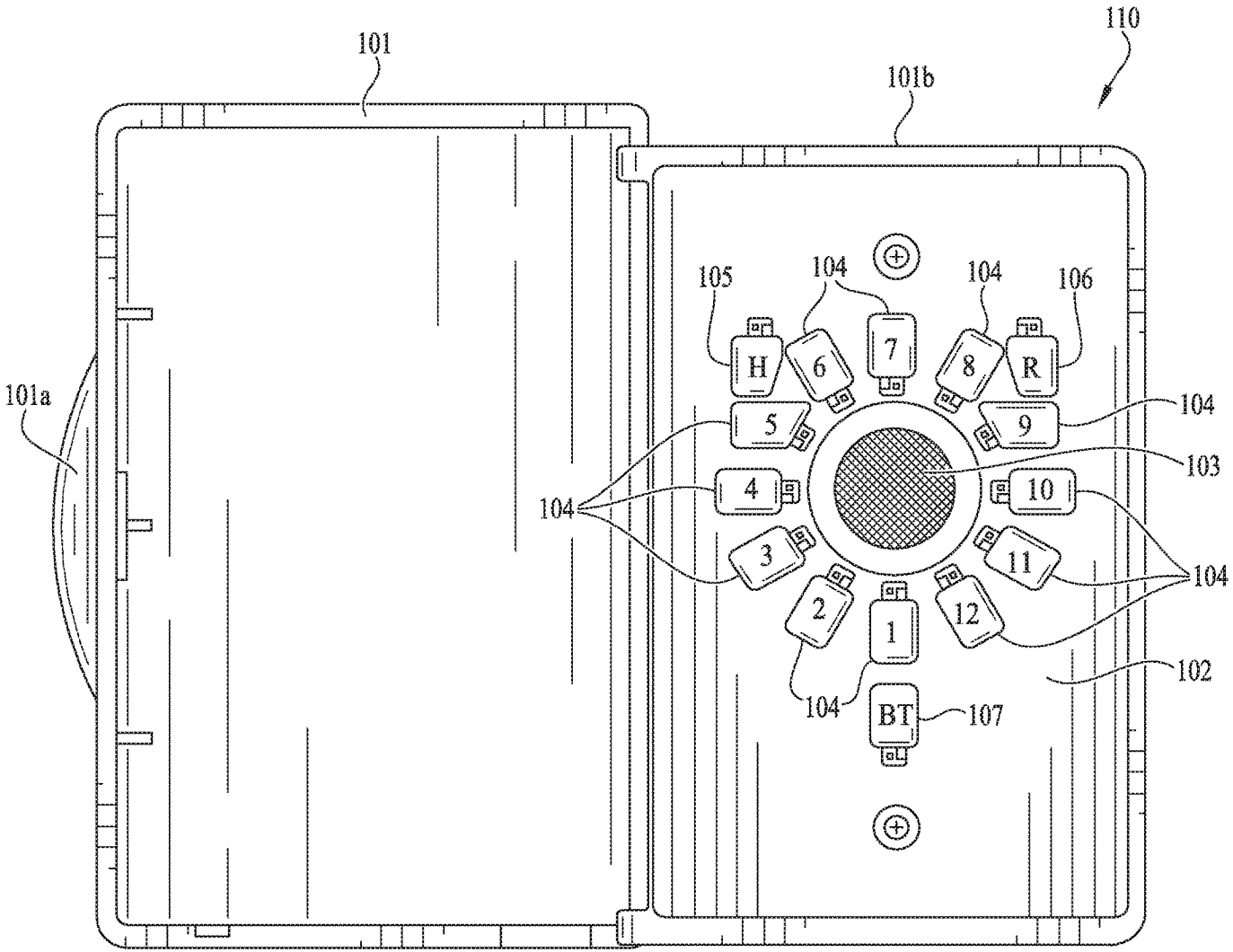
FIG. 1A is a front elevation view of a control panel of an LED lighting control device that is capable of remotely controlling an LED lamp over a Bluetooth wireless link in accordance with a first example embodiment of the present invention.

In accordance with example embodiments, an LED lamp is provided that is capable of being controlled wirelessly and remotely by an LED lighting control device. The LED lamp has an antenna that exits the main optic on a face of the LED lamp and that is concealed on the face of the LED lamp in a raised section of lens material. Locating the antenna in the raised section of lens material allows the LED lamp to be controlled by a stronger control signal from the LED lighting control device at greater distances (e.g., typically greater than ten feet) and does not detract from the aesthetic appeal of the LED lamp.

Exemplary, or representative, embodiments of an LED lighting system and of the LED lighting control device are described below with reference to the figures, in which like reference numerals represent like components, elements or features.

It should also be understood that the word "example," as used herein, is intended to be non-exclusionary and non-limiting in nature. More particularly, the word "exemplary," as used herein, indicates one among several examples, and it should be understood that no undue emphasis or preference is being directed to the particular example being described. It should also be understood that the word "exemplary," as used herein, is intended to be non-exclusionary and non-limiting in nature.

The terminology used herein is for purposes of describing particular embodiments only, and is not intended to be limiting. The defined terms are in addition to the technical, scientific, or ordinary meanings of the defined terms as commonly understood and accepted in the relevant context.

The terms "a," "an" and "the" include both singular and plural referents, unless the context clearly dictates otherwise. Thus, for example, "a device" includes one device and plural devices. Where a first device is said to be directly connected or directly coupled to a second device, this encompasses examples where the two devices are connected together without any intervening devices other than bonding material or devices. Where a first device is said to be coupled to a second device, this encompasses examples where the two devices are directly connected together without any intervening devices other than bonding material or devices and examples where the first and second devices are connected to one another via one or more intervening devices. The term "electrically coupled," as that term is used herein, encompasses examples where two devices or elements are directly electrically connected together without any intervening devices or elements and examples where the two devices or elements are electrically connected to one another via one or more intervening devices or elements.

A "control device," as that term is used herein, denotes an electronic component or circuit that is configured to carry out operations by which the control device controls some other device. The control device may be, for example, a microprocessor or a microcontroller that executes computer instructions in the form of software and/or firmware. As another example, the control device may be electrical hardware that is configured in such a way as to carry out operations by which the control device controls some other device. As yet another example, the control device may be a combination of electrical hardware and software and/or firmware configured in such a way as to carry out operations by which the control device controls some other device. References herein to a system comprising "control device" should be interpreted as a system having one or more control devices.

The term "memory" or "memory device", as those terms are used herein, are intended to denote a non-transitory computer-readable storage medium that is capable of storing computer instructions, or computer code, for execution by one or more control devices. Memory may also store various types of data, which is of particular focus of the inventive principles and concepts discussed herein. References herein to "memory" or "memory device" should be interpreted as one or more memories or memory devices. The memory may, for example, be multiple memories within the same system. The memory may also be multiple memories distributed amongst multiple systems or control devices.

A "Bluetooth wireless link," as that term is used herein, denotes a wireless link that operates in accordance with Bluetooth® standards of the Bluetooth Special Interest Group (SIG), which is a corporation headquartered in Kirkland, Washington. The Bluetooth® standards are wireless technology standards for exchanging data over short distances using short-wavelength ultra high frequency (UHF) radio waves in the industrial, scientific and medical (ISM) radio band.

Figure 1B:
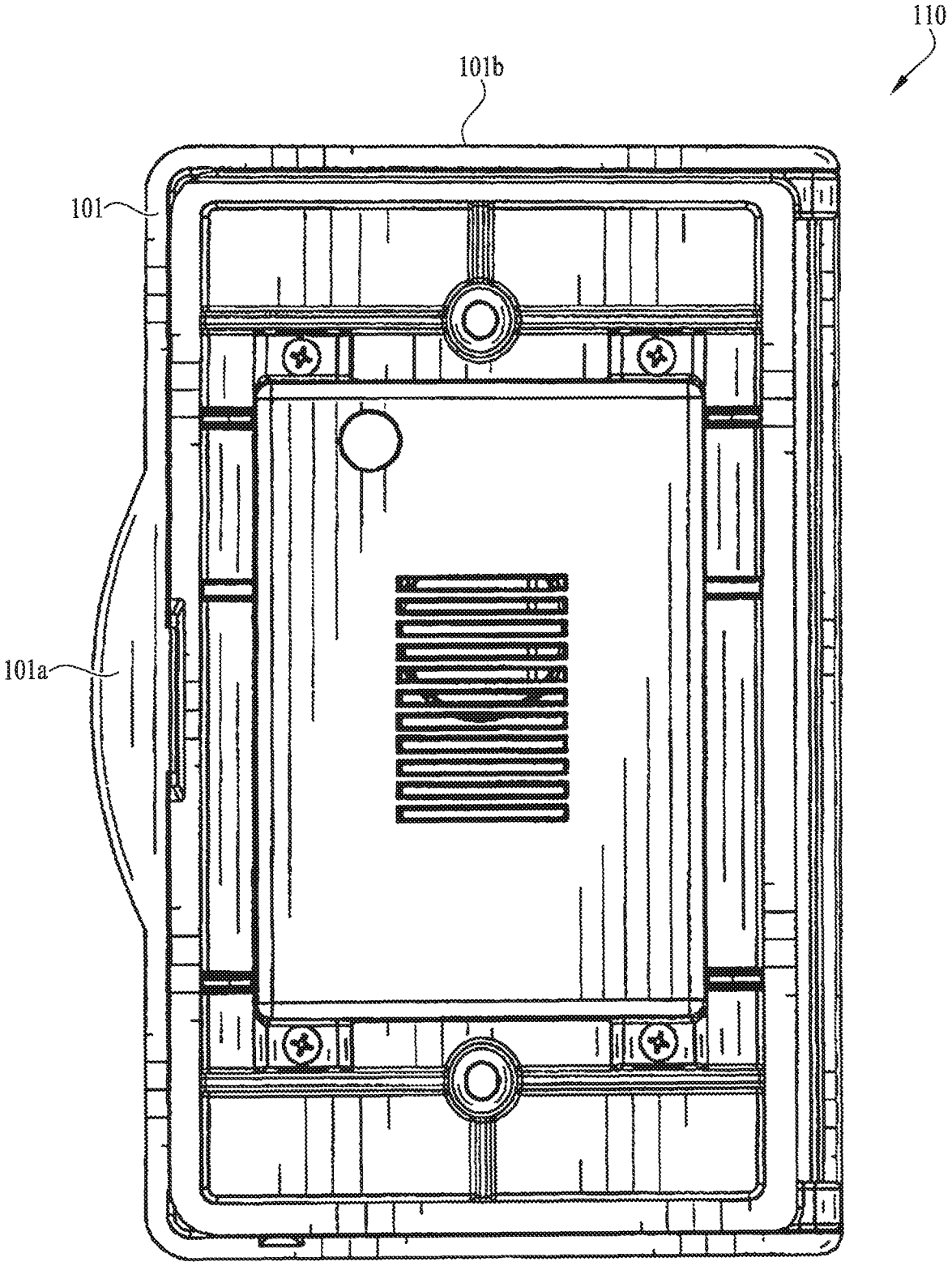
FIG. 1B is a rear elevation view of the LED lighting control device shown in FIG. 1A.
Figure 1C:
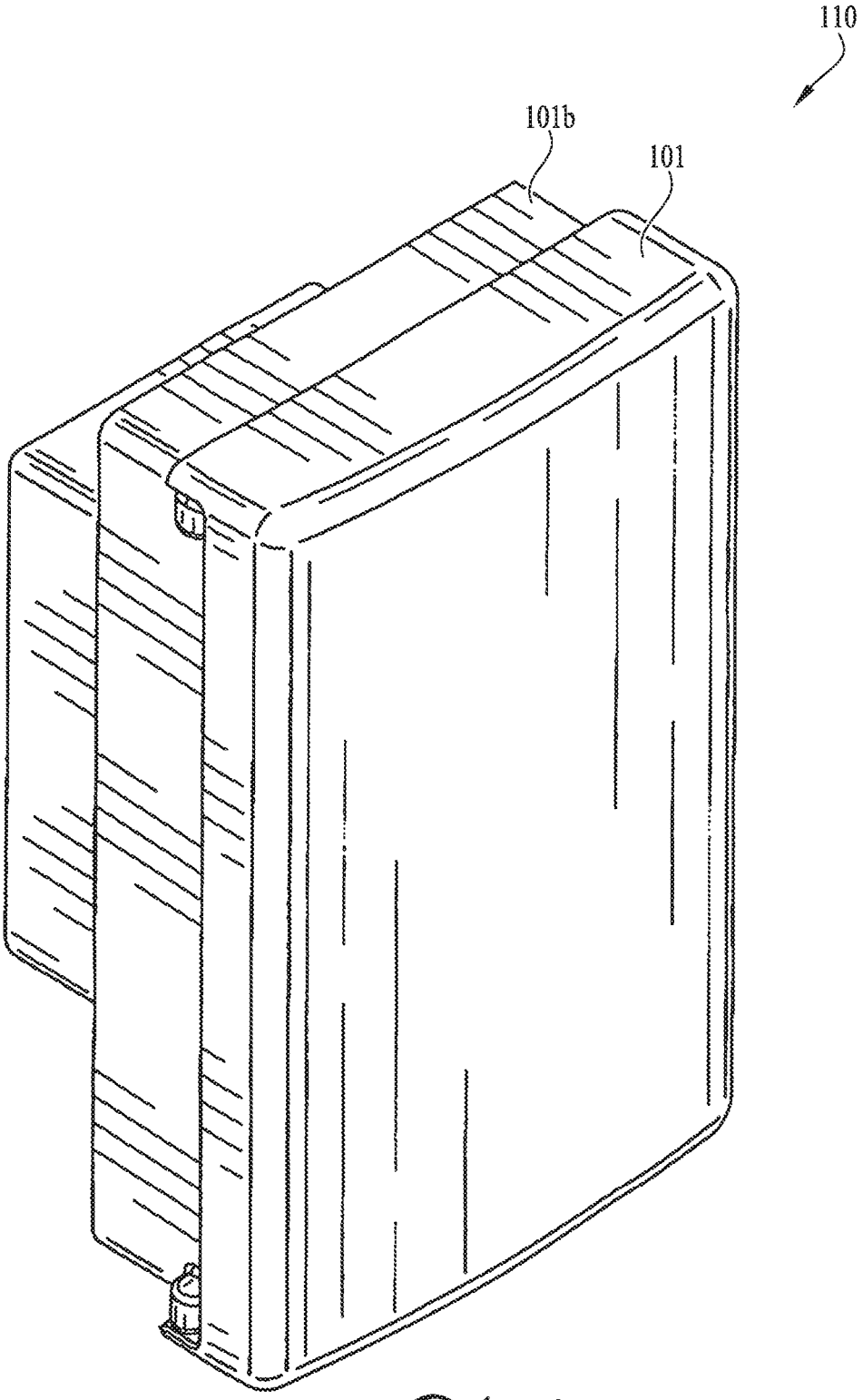
FIG. 1C is a front perspective view of the LED lighting control device shown in FIGS. 1A and 1B and shown with a cover portion thereof in a closed position.
Figure 1D:
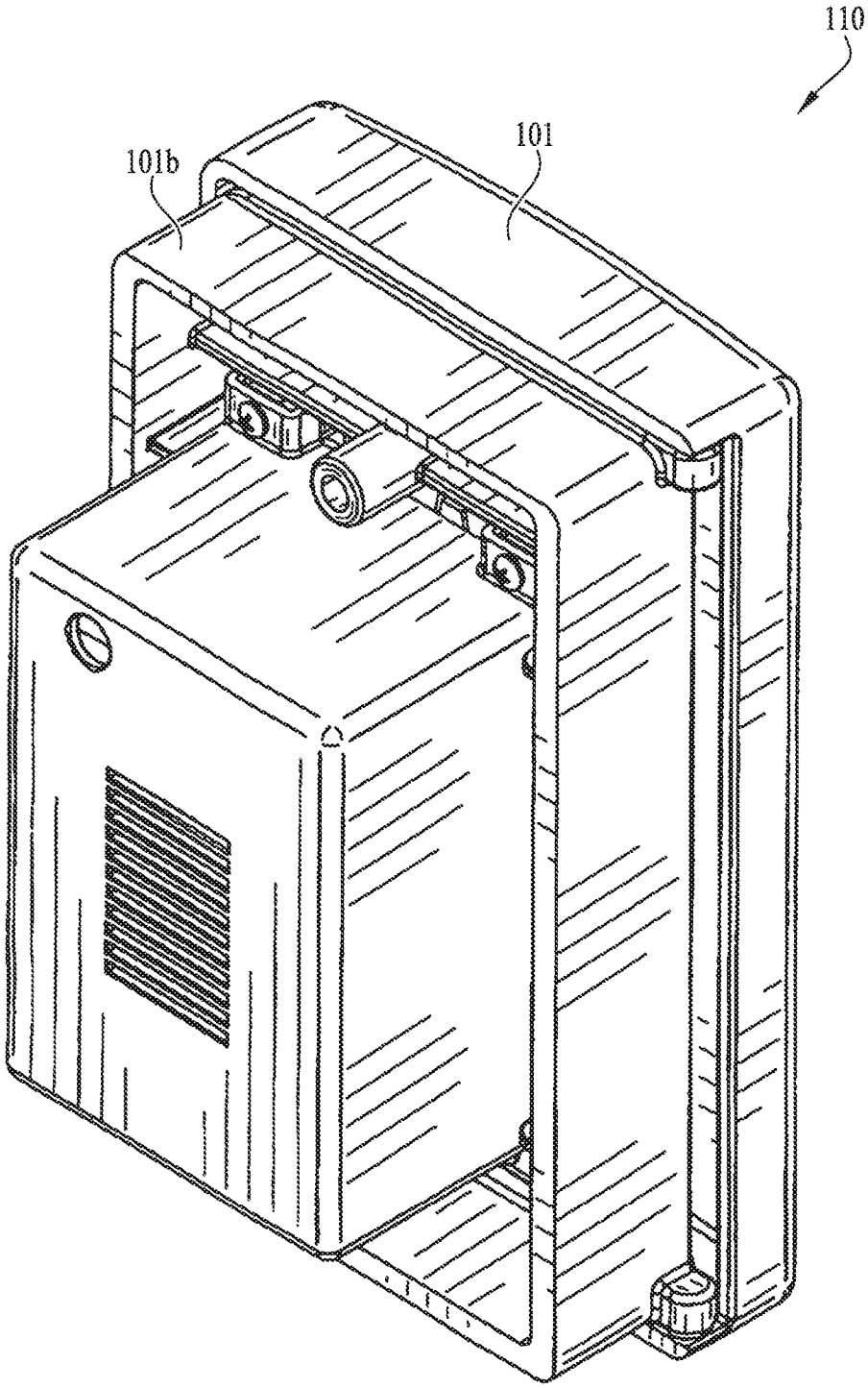
FIG. 1D is a rear perspective view of the LED lighting control device shown in FIGS. 1A-1C.

FIG. 1A is a front view of the LED lighting control device 110 in accordance with a representative embodiment in an opened position in which a door or cover 101 of the LED lighting control device 110 is opened to allow a user to access a user interface (UI) 102 of the LED lighting control device 110. FIG. 1B is a rear view of the LED lighting control device shown in FIG. 1A in accordance with a representative embodiment with the door 101 in a closed position. FIG. 1C is a front perspective view of the LED lighting control device 110 shown in FIGS. 1A and 1B in accordance with a representative embodiment with the door 101 in the closed position. FIG. 1D is a rear perspective view of the LED lighting control device 110 shown in FIGS. 1A-1C in accordance with a representative embodiment with the door 101 in the closed position.

Figure 2:
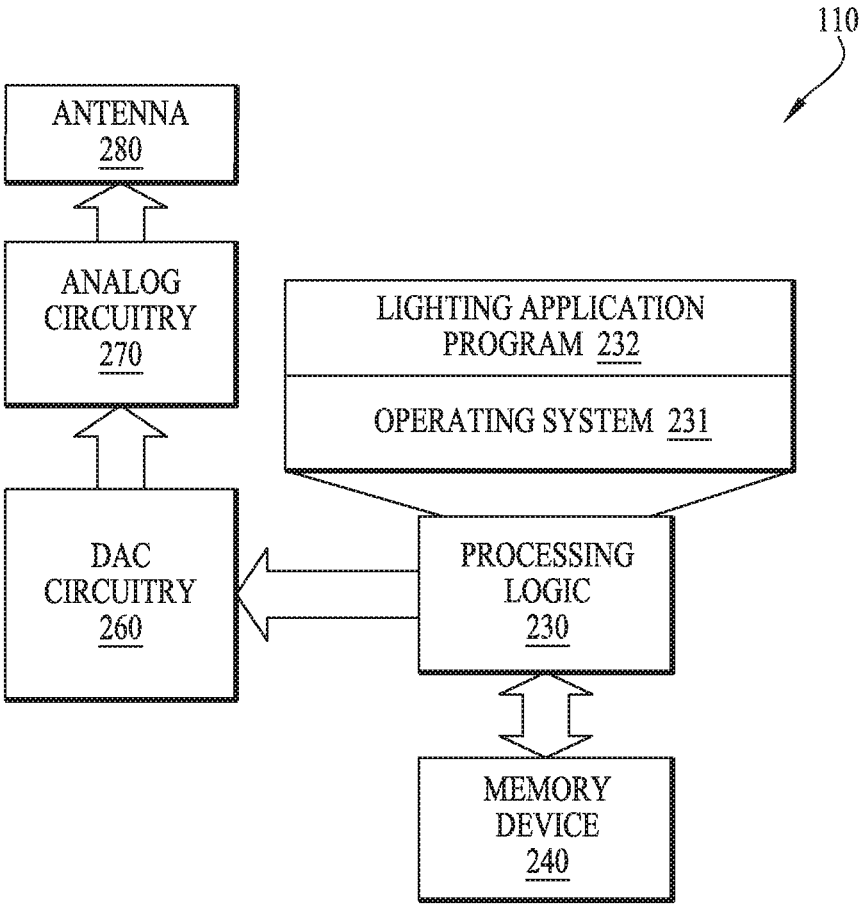
FIG. 2 is a schematic block diagram of the LED lighting control device shown in FIGS. 1A-1D.
Figure 3A:
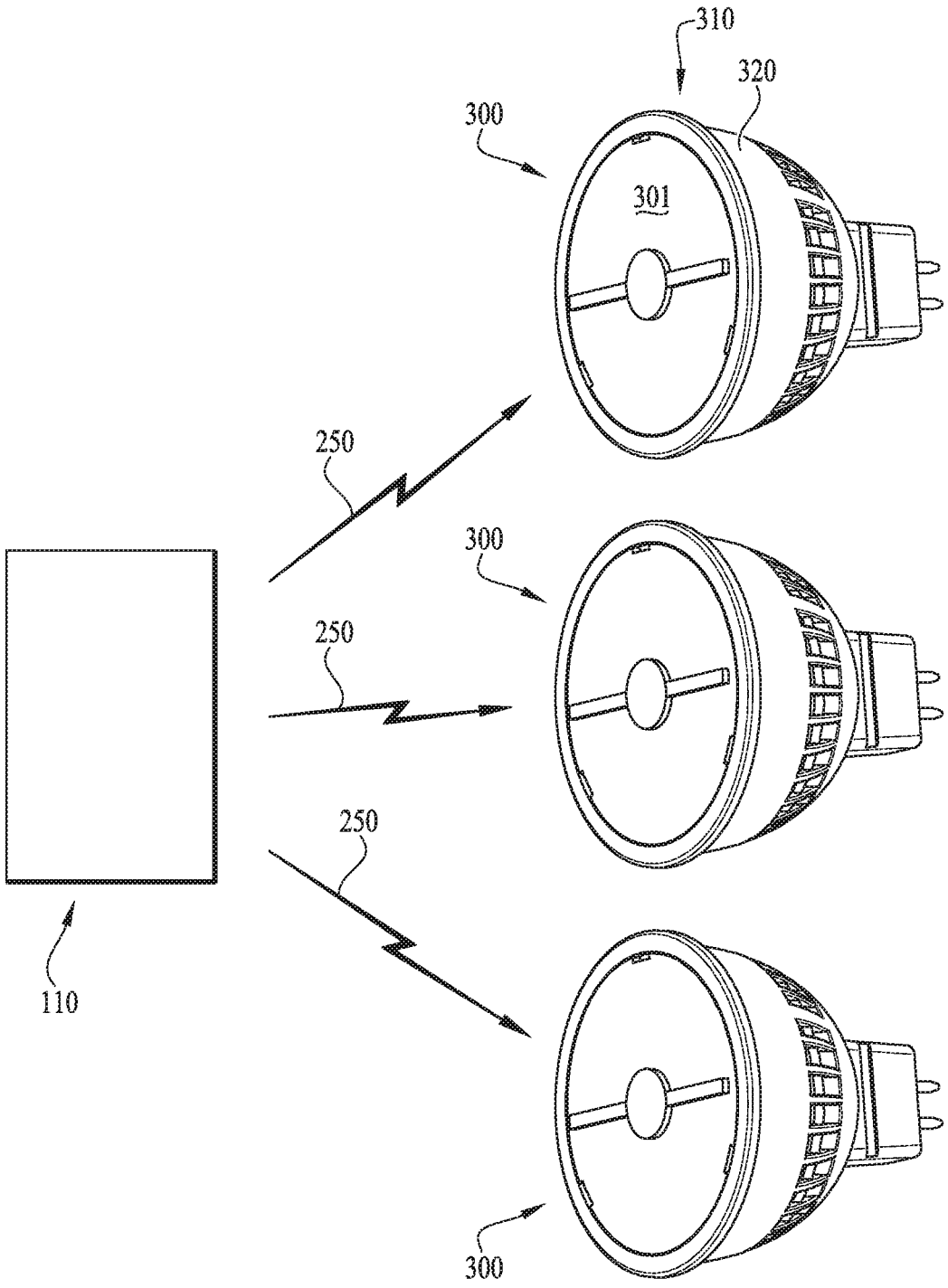
FIG. 3A is a schematic functional diagram depicting an example LED lighting control device as shown in FIGS. 1A-2 and showing it wirelessly controlling multiple example LED lamps.
Figure 3B:
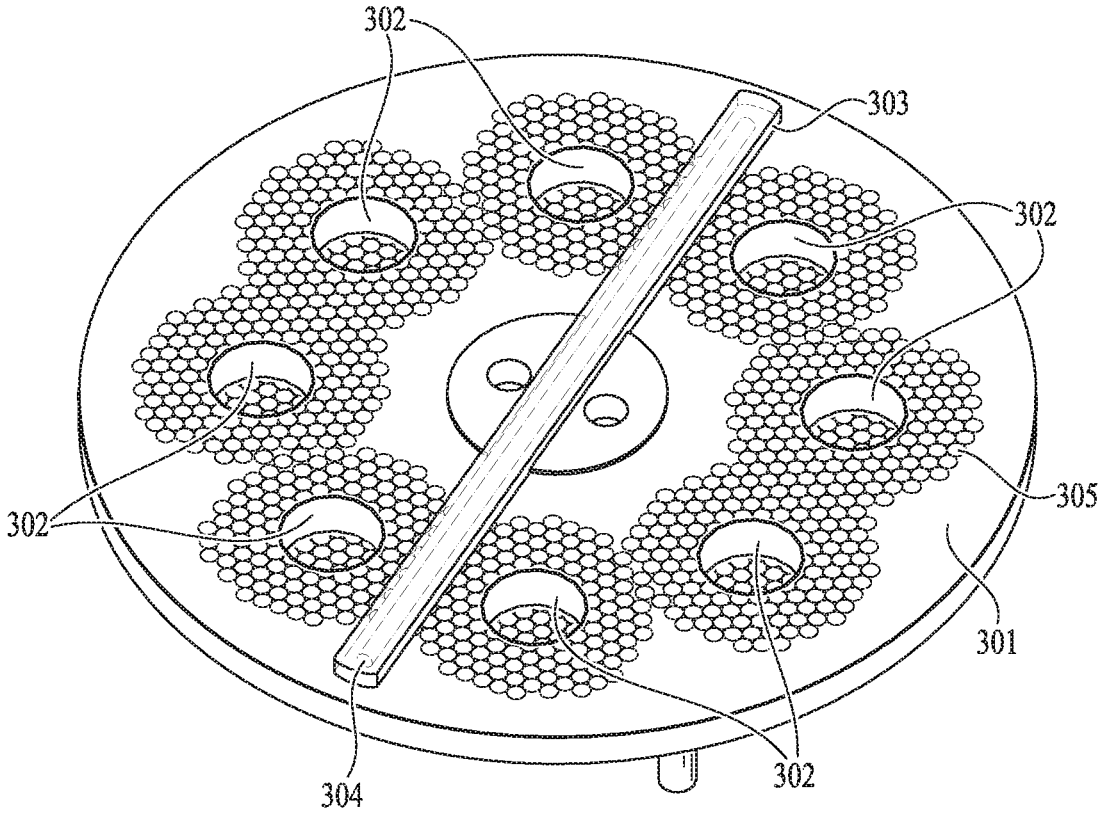
FIGS. 3B and 3C are top front perspective and plan views, respectively, of an example lens portion of the LED lamp as shown in FIG. 3A.

FIG. 2 is a schematic block diagram of the LED lighting control device 110 shown in FIGS. 1A-1D in accordance with a representative embodiment. FIGS. 3A and 3B are plan and top perspective views, respectively, of the LED lamp 300 that is remotely controlled by the LED lighting control device 110 shown in FIGS. 1A-2.

With reference to FIG. 1A, the door 101 includes an outwardly projecting tab 101*a* that allows the user to easily grip the door 101 to move the door 101 from the closed position to an opened position, and vice versa. The door 101 is hingedly attached to a housing 101*b* of the LED lighting control device 110 that houses the components shown in FIG. 2. In accordance with this representative embodiment, a user interface or UI 102 comprises a control panel having an on/off button 103, a plurality of lighting scheme icons or buttons 104, a hold button 105, a recall button 106 and a Bluetooth button 107. Each of the lighting scheme icons 104 corresponds to a respective pre-programmed lighting scheme that the LED lamp 300 (FIGS. 3A and 3B) can display. In accordance with a representative embodiment, a plurality of the pre-programmed lighting scheme icons 104 correspond to respective solid colors that can be displayed by the LED lamp and a plurality of the lighting scheme icons 104 correspond to respective color light shows. While numerals are depicted on the buttons/icons 104, other indicia can be employed as desired, such as symbols, letters, colors, etc.

During manual operations of the LED lighting control device 110, when the user selects one of the lighting scheme icons 104 by pressing the corresponding lighting scheme icon 104, the selected lighting scheme icon 104 is illuminated to indicate the active selection. If the recall button 106 is selected by the user, the last color or color show that was displayed becomes the current active selection. Depressing the hold button 105 causes the LED lighting control device 110 to lock to the color that is currently displayed. Depressing the Bluetooth button 107 causes the LED lighting control device 110 to enter the remote mode of operations during which the LED lighting control device 110 is remotely controlled by a Bluetooth-enabled device (not shown) operated by a user.

FIG. 2 illustrates a block diagram of the LED lighting control device 110 shown in FIGS. 1A-1D in accordance with a representative embodiment. The LED lighting control device 110 comprises processing logic 230, a non-transitory memory device 240, digital-to-analog conversion (DAC) circuitry 260, front end analog circuitry 270 and an antenna 280.

In accordance with an embodiment, based on a user-selected lighting scheme, the LED lighting control device 110 sends radio frequency (RF) control signals to the LED lamp 300 via the antenna 280 to instruct the LED lamp 300 to display a particular lighting scheme. The processing logic 230 may be implemented solely in hardware or in a combination of hardware and software and/or firmware. For illustrative purposes, it is assumed that the processing logic 230 is implemented as a microcontroller or a microprocessor that executes software and/or firmware of a lighting application program 232. In accordance with a representative embodiment, the memory device 240 stores computer instructions comprising the lighting application program 232, which is executed by the processing logic 230 when the LED lighting control device 110. In accordance with an embodiment, the processing logic 230 executes computer instructions comprising an operating system 231 that controls the operations of the LED lighting control device 110, including operations performed by the LED lighting control device 110 when the processing logic 230 is executing the lighting application program 232.

FIG. 3A is a schematic functional diagram depicting an example LED lighting control device 110 as shown in FIGS. 1A-2 and showing it wirelessly controlling multiple example LED lamps 300. With reference to FIG. 3A, the LED lighting control device 110 is shown controlling multiple LED lamps 300. This is accomplished wirelessly, using a Bluetooth wireless coupling 250. Each LED lamp 300 includes a housing 310 including a narrow bowl-shaped body 320 and a lens 301.

Figure 3C:
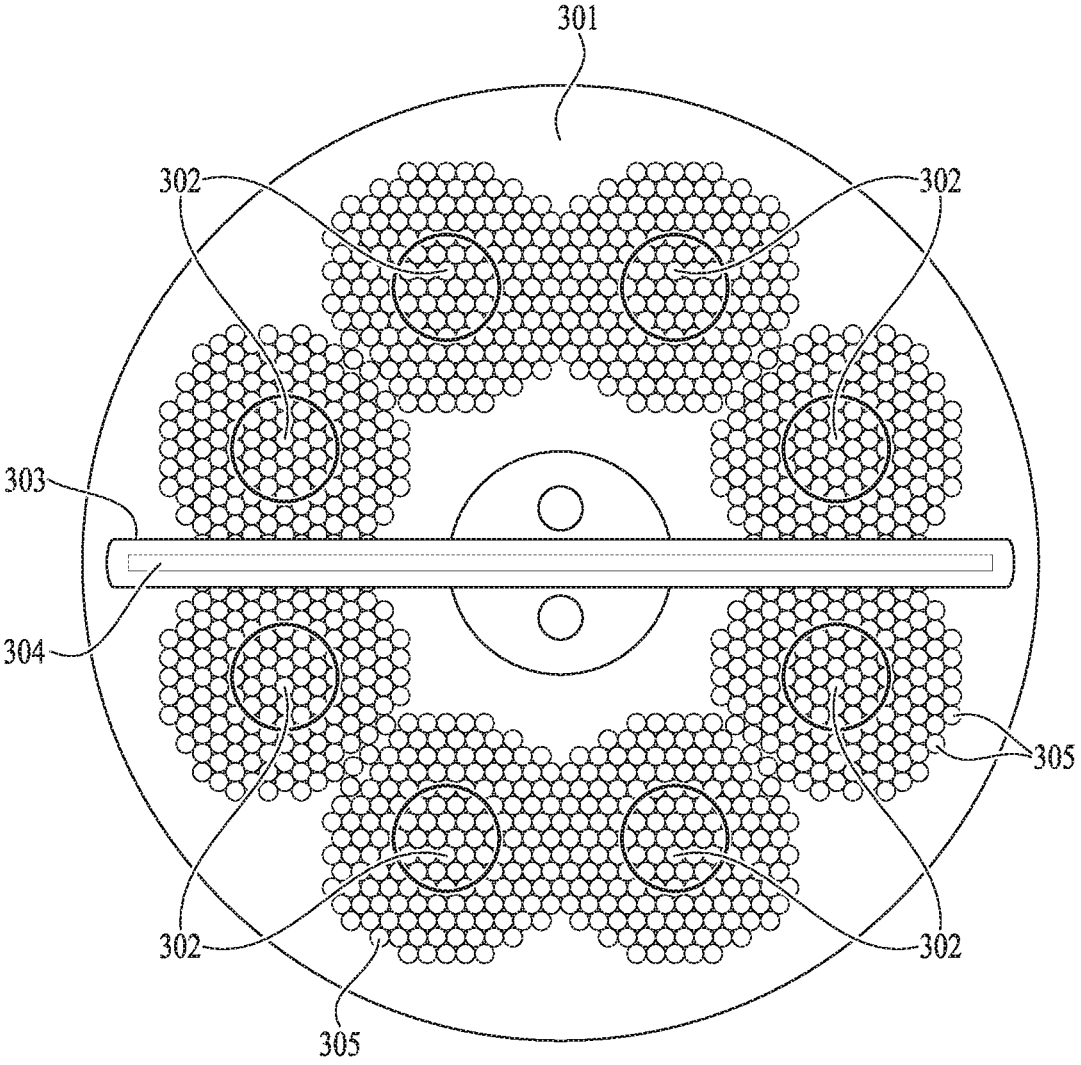

FIGS. 3B and 3C are top front perspective and plan views, respectively, of an example lens portion 301 of the LED lamp 300 as shown in FIG. 3A. As shown in more detail in these figures, in one optional form the LED lamp 300 has a lens 301 that includes a plurality of medium-sized lens diffusers 302 and a large number of smaller diffuser lenses 305 surrounding each of the medium-sized lens diffusers 302. For each medium-sized lens diffuser 302 there are dozens of small diffuser lenses 305 surrounding each and they extend outwardly therefrom to such an extent that they more or less connect with or engage the small diffuser lenses 305 from an adjacent medium-sized diffuser lens 302.

The lens 301 is generally disk-shaped and has an antenna 304 extending and traversing across the lens, generally from one side to the other. The antenna need not traverse the entirety of the lens. But generally speaking, the longer the antenna, the better the reception the antenna 304 can pull in. So it is preferred that the antenna be longer rather than shorter and it is preferred that it traverse as much of the lens as is practicable.

Optionally, the lens 301 includes a raised section or rib 303 in which all or at least a portion of an antenna 304 is embedded. An end of the antenna is electrically coupled to the electrical circuitry of the LED lamp 300. Embedding the antenna 304 in the lens material protects the antenna 304 and prevents it from being damaged while allowing the antenna 304 to receive the RF control signals transmitted by the LED lighting control device 110. The lens material is typically a plastic, non-conductive material that is transparent to the RF wavelength or RF wavelength range. Optionally, the lens material can be glass or other materials as desired. Embedding the antenna 304 in the lens material also does not detract from the aesthetic appeal of the LED lamp 300.

Figure 4:
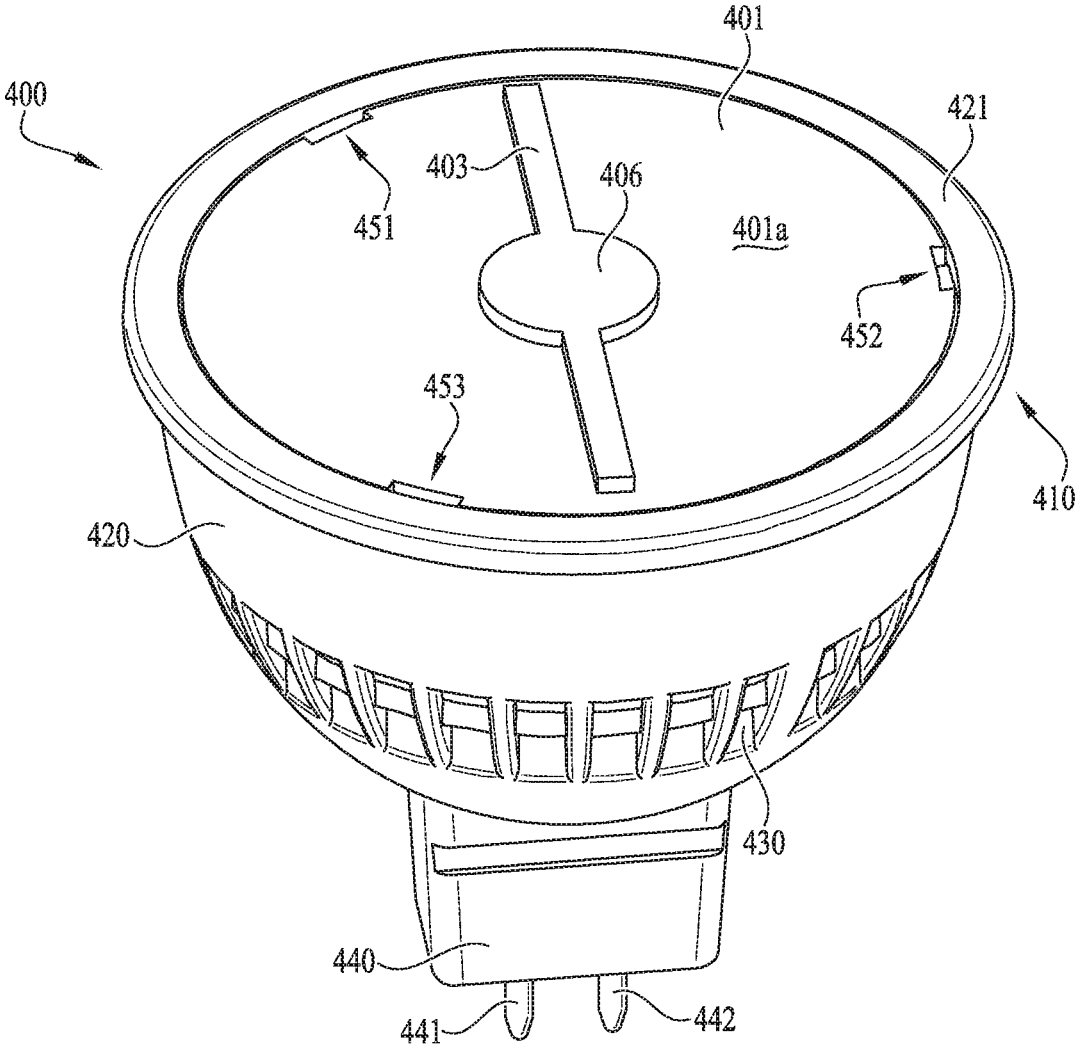
FIG. 4 is a schematic perspective view of an example LED lamp adapted to be remotely controlled by the LED lighting control device shown in FIGS. 1A-2.

FIG. 4 is a schematic perspective view of an example LED lamp 400 adapted to be remotely controlled by the LED lighting control device 110 shown in FIGS. 1A-2. The LED lamp 400 includes a housing 410 including a narrow bowl-shaped body 420 and a lens 401. In this optional form, the lens 401 does not include lens diffusers on the front face 401*a* of the lens 401. Instead, as will be seen in subsequent figures, the lens 401 is provided with more or less internal lens diffusers.

The lens 401 is generally disk-shaped and has an antenna 404 extending and traversing across the lens, generally from one side to the other. Optionally, the lens 401 includes a raised section or rib 403 in which all or at least a portion of an antenna 404 is embedded. The rib 403 intersect a raised button portion 406 positioned in the center of the disk-shaped lens. The lens 401 is formed as a separate element from the body 420 and is designed to snap into place into a front rim portion 421 of the body 420 and be secured thereat, as will be seen in subsequent figures. The snap features are positioned equidistant around the edge of the lens at positions 451, 452, 453. An end of the antenna is electrically coupled to the electrical circuitry of the LED lamp 400.

The narrow bowl-shaped body 420 of the housing 410 bears a plurality of cooling vents or apertures, such as aperture 430. These apertures or openings are positioned in a middle portion of the bowl-shaped body 420 and extend all the way around the body 420 in a circle. A slightly tapered rectangular base portion 440 is formed at a distal end of the housing 410 and carries two electrical prongs or terminals 441, 442 extending therethrough for connection to a source of electrical power.

Figure 5A:
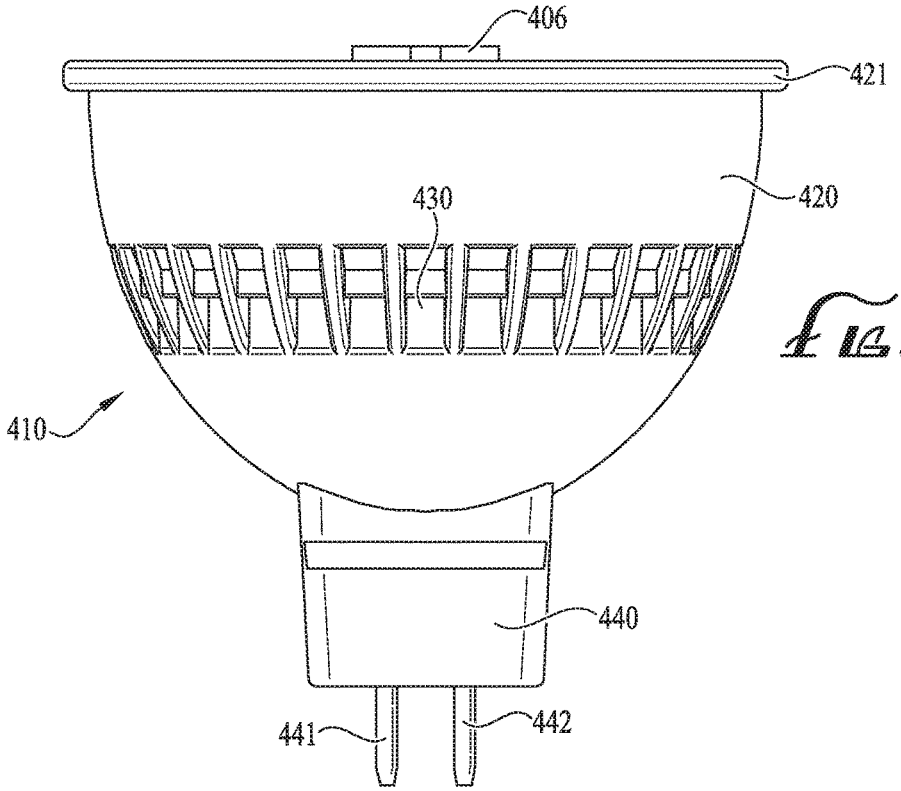
FIGS. 5A, 5B and 5C are side, front, and sectional views, respectively, of an LED lamp as shown in FIG. 4.
Figure 5B:
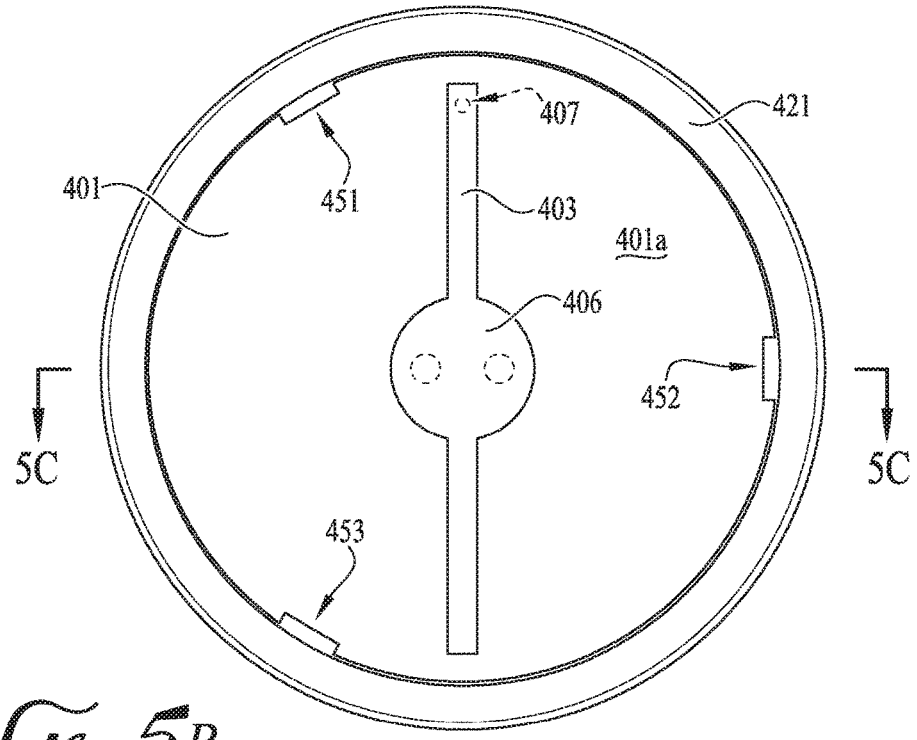
Figure 5C:
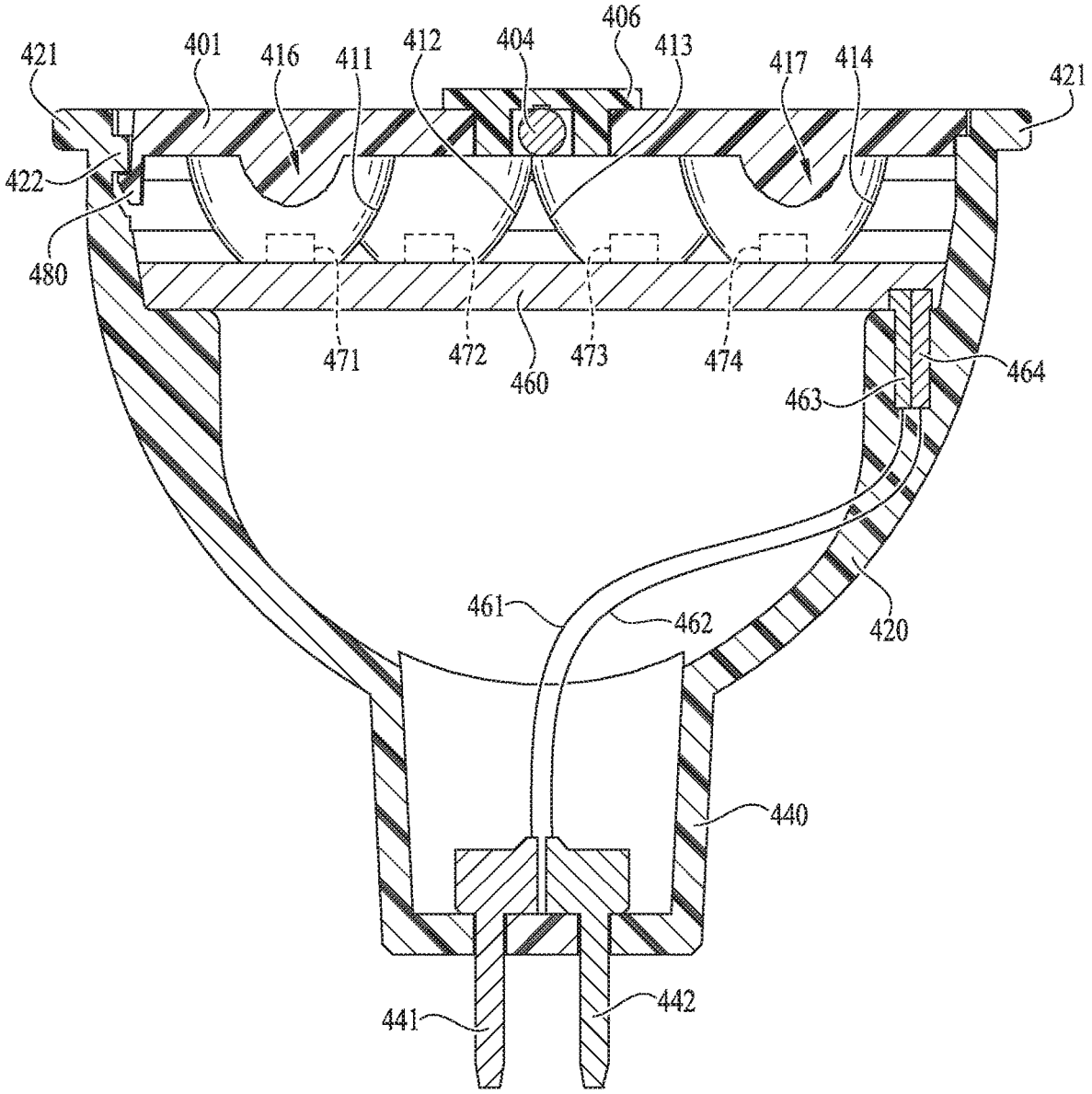

FIGS. 5A-5C are side, front, and sectional views respectively of the LED lamp 400 as shown in FIG. 4. As best seen in the sectional view in FIG. 5C, the terminals 441, 442 extend through the base portion 440 and are connected to electrical wires 461, 462. These wires extend to and couple with connectors 463, 464 embedded in the body 420. The connectors 463, 464 connect to and provide electrical power to a circuit board 460. The circuit board houses the electronics of the lamp 400 and bear LED emitters, such as emitters 471, 472, 473, 474. The emitters 471, 472, 473, 474 are mounted on the circuit board 460 and extend somewhat into reflector elements 411, 412, 423, 414 formed in or attached to the lens 401. The lens 401 also includes diffuser elements, such as diffusers 416 and 417. Preferably, each emitter is positioned in a reflector and has an associated diffuser. The antenna 404 is connected to the circuit board 460 by an antenna lead or wire 407.

The lens 401 is secured in place by three barbed tabs or barbed prongs, such as barbed tab 480. These are somewhat bendable to allow the barbs to be deflected slightly as the lens is snapped into place. The barbed tabs grab the underside of a ledge 422 formed in the inside portion of the rim 421. The upper side of the ledge 422 acts as a stop, so that lens 401 is snugly held in place when snapped into place.

Figure 6:
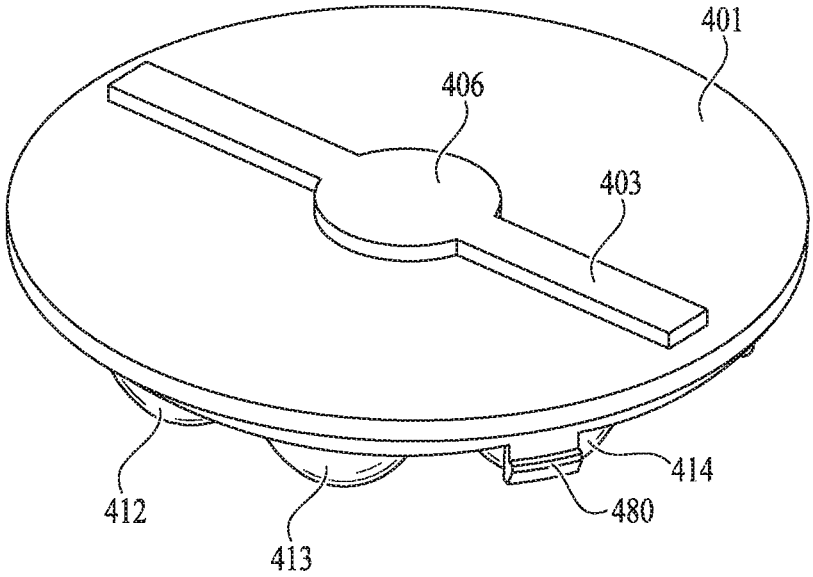
FIG. 6 is a schematic perspective view of a lens portion of the LED lamp as shown in FIG. 4.
Figure 7A:
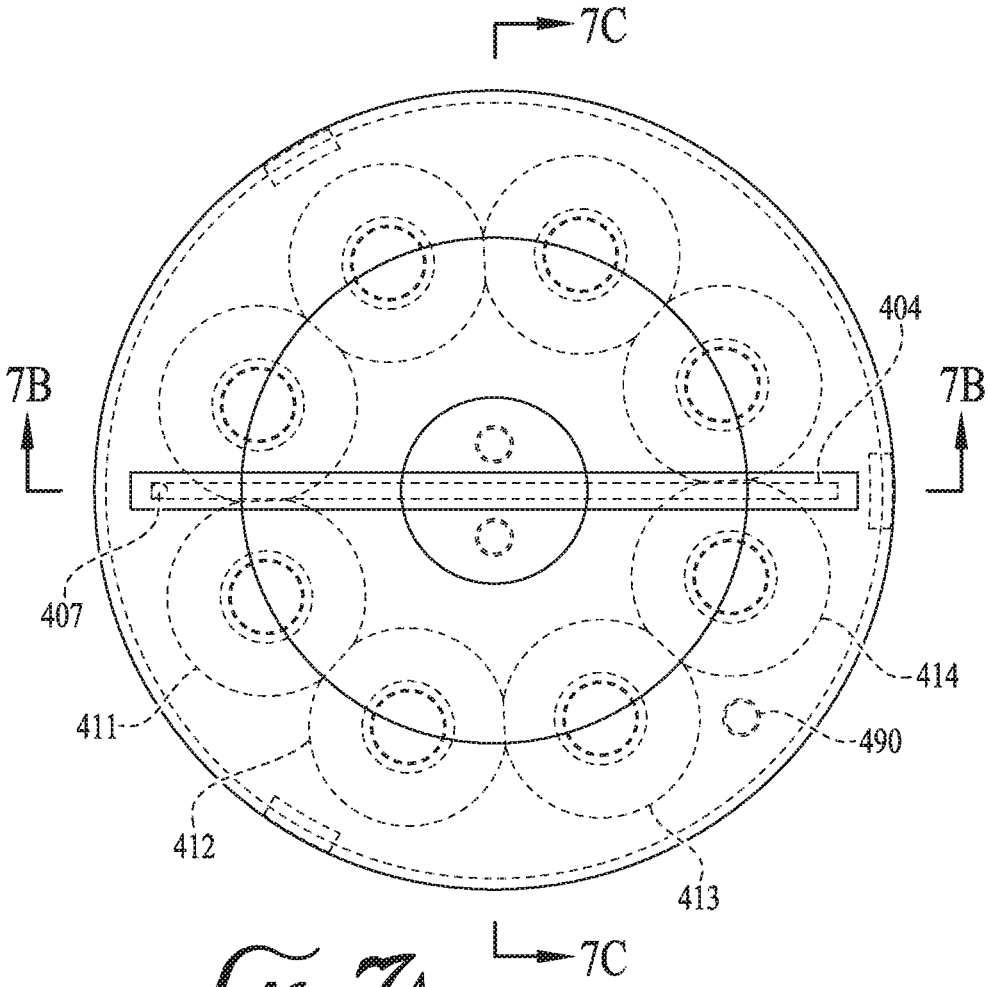
FIG. 7A is a front view of the lens portion of the LED lamp as shown in FIG. 6.
Figure 7B:
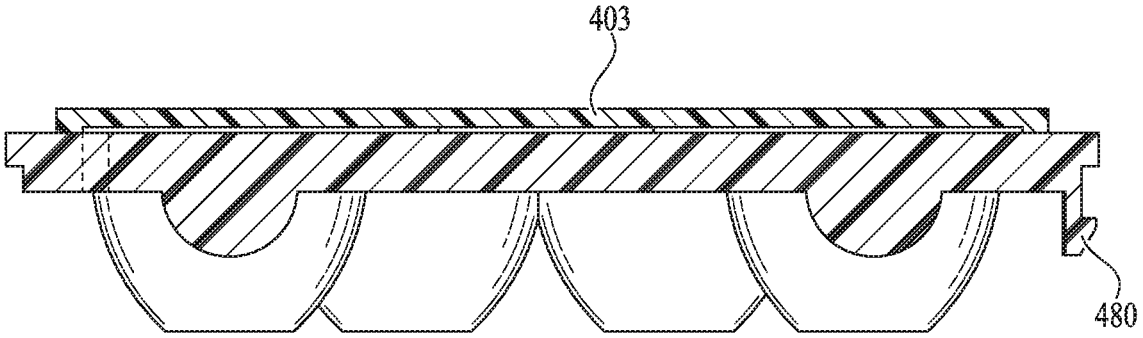
FIGS. 7B and 7C are sectional views of the lens portion of the LED lamp as shown in FIG. 6.

As shown in FIG. 7A, the lens 401 includes eight emitter reflectors, such as reflectors 411, 412, 413, 414. is a front view of the lens portion of the LED lamp as shown in FIG. 6.

Figure 7C:
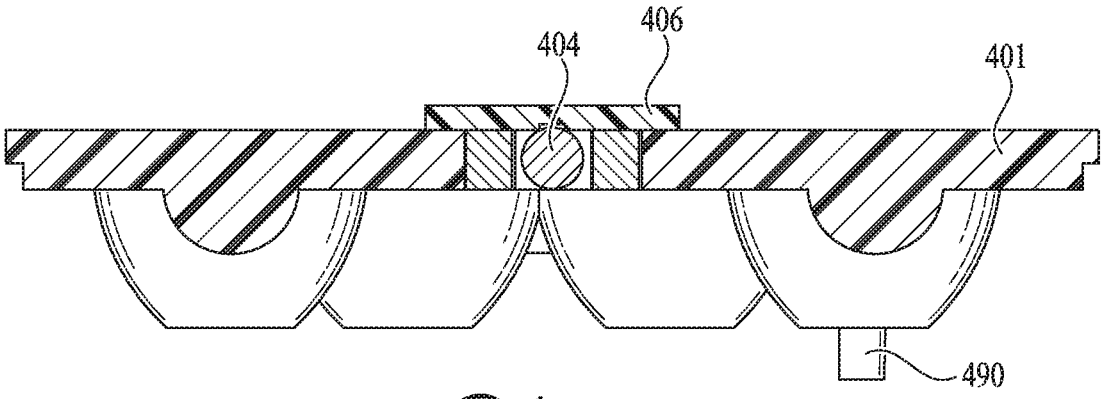

As seen in FIGS. 7A and 7C, the lens 401 includes a positioning lug 490 for insertion into a positioning aperture in the circuit board 460 or in the body 420. In this way, the lens can only be inserted into the body in one orientation, ensuring that the reflectors are properly positioned over the emitters.

It should be noted that embodiments described herein are intended to demonstrate inventive principles and concepts and that the inventive principles and concepts are not limited to these embodiment. For example, the LED lamp 300 may be used with LED lighting control devices that are different from the configuration of the LED lighting control device 110 shown in FIGS. 1A-2 is an example of one suitable configuration of the LED lighting control device 110, but other suitable configurations can be used. These and many other modifications can be made to the representative embodiment without deviating from the scope of the invention, as will be understood by those of skill in the art in view of the description provided herein.

What is claimed is:

1. A light emitting diode (LED) lamp comprising:
- a lamp housing including a body portion and a lens;
- at least one LED emitter secured within the lamp housing;
- electrical circuitry secured within the lamp housing and electrically coupled to the at least one LED emitter; and
- an antenna that is electrically coupled to the electrical circuitry, wherein at least a portion of the antenna is positioned adjacent the lens.

2. The LED lamp as claimed in claim 1 wherein at least a portion of the antenna is embedded in the lens.

3. The LED lamp as claimed in claim 1 wherein the lens includes a rib that extends at least partly across the lens and wherein at least a portion of the antenna is embedded in the rib.

4. The LED lamp as claimed in claim 1 wherein the rib substantially bisects the lens.

5. The LED lamp as claimed in claim 1 wherein the antenna traverses most of the lens.

6. The LED lamp as claimed in claim 1 wherein the lens and the body portion are separate elements and the lens is attached to the body portion.

7. The LED lamp as claimed in claim 1 wherein the lens and the body portion are separate elements and the lens is attached to the body portion with a fastener-free snap-fit.

8. The LED lamp as claimed in claim 1 wherein the lens and the body portion are separate elements and the lens is secured to the body portion with a barbed tab formed on either the lens or the body portion.

9. The LED lamp as claimed in claim 1 wherein the antenna comprises a Bluetooth antenna.

10. The LED lamp as claimed in claim 1 wherein the antenna comprises a dipole antenna.

11. A light emitting diode (LED) lamp comprising:
- a housing comprising a lens;
- an LED disposed inside of the housing;
- electrical circuitry electrically coupled to the LED; and
- an antenna that is electrically coupled to the electrical circuitry, wherein at least a portion of the antenna is embedded in the lens.

12. The LED lamp of claim 11, wherein said at least a portion of the antenna is embedded in a raised portion of the lens.

13. The LED lamp as claimed in claim 11 wherein the housing includes a body portion and wherein the lens and the body portion are separate elements and the lens is attached to the body portion.

14. The LED lamp as claimed in claim 11 wherein the housing includes a body portion, and wherein the lens and the body portion are separate elements and the lens is attached to the body portion with a fastener-free snap-fit.

15. An LED lighting system comprising:
- a plurality of LED lamps, the LED lamps comprising a housing having a lens, an LED emitter, electrical circuitry, and an antenna coupled to the circuitry and positioned adjacent the lens; and
- a wireless controller comprising a controller housing, controller circuitry including a Bluetooth wireless transmitter, and a user interface, and wherein the controller circuitry is operative for sending Bluetooth signals from the wireless controller to the antennas in the LED lamps to effect remote, wireless control of the LED lamps from the wireless controller.

16. The LED lighting system as claimed in claim 15 wherein at least a portion of the antenna is embedded in the lens.

17. The LED lighting system as claimed in claim 15 wherein the lens includes a rib that extends at least partly across the lens and wherein at least a portion of the antenna is embedded in the rib.

18. The LED lighting system as claimed in claim 15 wherein the antenna traverses most of the lens.

19. The LED lamp as claimed in claim 15 wherein the housing includes a body portion, wherein the lens and the body portion are separate elements and the lens is attached to the body portion.

20. The LED lamp as claimed in claim 19 wherein the lens is attached to the body portion with a fastener-free snap-fit.

* * * * *